United States Patent [19]

Horn

[11] 4,386,789

[45] Jun. 7, 1983

[54] SKI BINDING

[75] Inventor: Hans Horn, Bern, Switzerland

[73] Assignee: TMC Corporation, Baar, Switzerland

[21] Appl. No.: 291,901

[22] Filed: Aug. 11, 1981

Related U.S. Application Data

[63] Continuation of Ser. No. 71,522, Aug. 31, 1979, abandoned.

[30] Foreign Application Priority Data

Sep. 5, 1978 [AT] Austria ..... 6395/78

[51] Int. Cl.[3] ..... A63C 5/00

[52] U.S. Cl. ..... 280/605

[58] Field of Search ..... 280/605, 604

[56] References Cited

U.S. PATENT DOCUMENTS

| | | | |
|---|---|---|---|
| 3,195,911 | 7/1965 | Cubberley | 280/605 |
| 3,909,024 | 9/1975 | Salomon | 280/605 |

FOREIGN PATENT DOCUMENTS

| | | | |
|---|---|---|---|
| 154159 | 9/1938 | Austria | 280/605 |
| 2513995 | 2/1976 | Fed. Rep. of Germany | 280/605 |
| 2613016 | 9/1977 | Fed. Rep. of Germany | 280/605 |
| 581478 | 11/1976 | Switzerland | 280/605 |
| 597880 | 4/1978 | Switzerland | 280/605 |

*Primary Examiner*—David M. Mitchell
*Assistant Examiner*—Milton L. Smith
*Attorney, Agent, or Firm*—Flynn, Thiel, Boutell & Tanis

[57] ABSTRACT

A ski binding mounted on a carriage reciprocally supported on a guide rail secured to a ski. A ski brake having a cam surface thereon is pivotally secured to the ski binding. An operating cam is secured to the guide rail or a component fixed to the ski and operatively engages the cam surface to (1) hold the ski brake in the retracted position when a ski boot is clamped in the ski bindings on the ski, and (2) effect a movement of the ski brake to the braking position when the thrust springs urge the ski binding and supporting carriage to its forwardmost position.

3 Claims, 4 Drawing Figures

Fig. 1
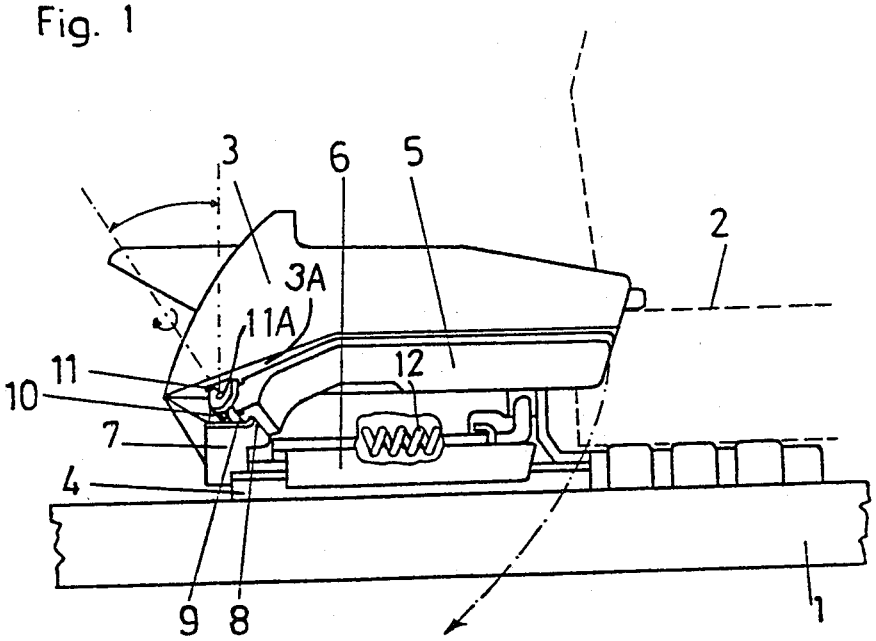
Fig. 2
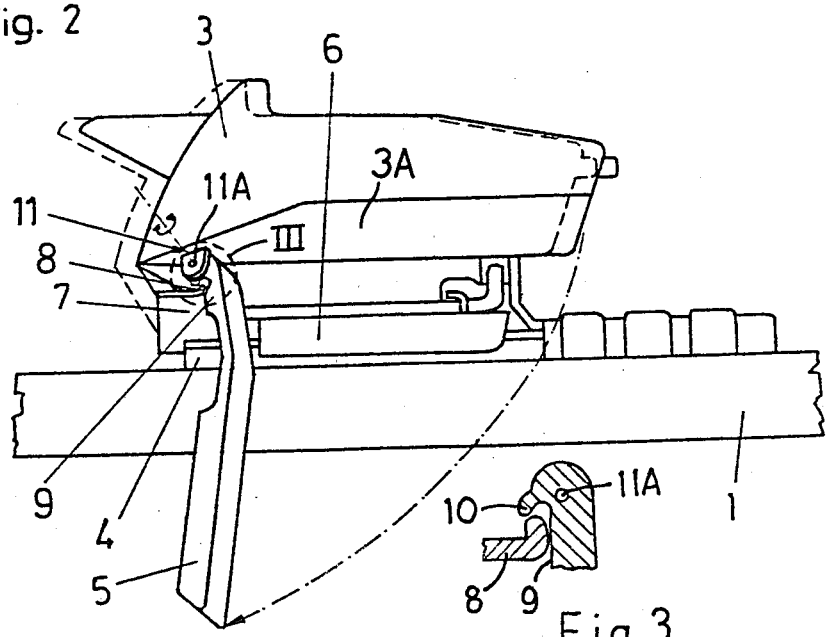
Fig. 3

SKI BINDING

This is a continuation of application Ser. No. 71,522, filed Aug. 31, 1979, now abandoned.

FIELD OF THE INVENTION

The invention relates to a ski binding having a holding mechanism which is movably supported in longitudinal direction of the ski and is pretensioned toward the ski boot and at least one braking member which is coupled for positive movement in response to the movement of the holding mechanism, wherein the braking member during removal of the ski boot from the ski binding swings from a retracted position into a braking position.

BACKGROUND OF THE INVENTION

Such a ski binding has become known from German Offenlegungsschrift No. 25 35 552. This ski binding uses a heel jaw, which is movably supported in longitudinal direction of the ski and is initially resiliently tensioned toward the ski boot. A braking lever is hingedly secured to a base plate mounted on the ski, which braking lever can be swung with the help of an operating arm from its braking position into its retracted position. The operating arm cooperates with a guide plate connected to a sole holder or housing, which performs a folding movement during opening or closing of the heel jaw. During folding down of the sole holder, a guide surface effects a swinging of the operating arm and thus the braking lever into the retracted position, while during removal of the ski boot from the ski binding, the guide surface which slides forwardly with the movable heel jaw releases the operating arm and thus the braking lever. However, this construction has proven not to be advantageous, since the desired cooperation of the guide plate and the operating arm is difficult to perform in practice. Furthermore, the ski brake requires a separate erecting spring.

Therefore, the basic purpose of the invention is to provide a ski binding of the above-mentioned type, which avoids these disadvantages.

For this purpose, the invention provides at least one operating cam, which engages a tooth system associated with the braking member, wherein the operating cam on the one hand and the braking member with tooth system on the other hand are supported on two relatively movable parts which carry out a relative movement during movement of the holding mechanism in longitudinal direction of the ski and swings the braking member during movement of the holding mechanism against a spring force from a braking position into a retracted position.

As an important advantage of this construction is shown the independency of the operation of a braking member from a possible folding movement of the holding mechanism. The new construction can thus also be used with a front jaw which is movable in longitudinal direction of the ski.

It is preferable for the braking member to be supported on the holding mechanism and the operating cam on a ski-fixed base plate.

Furthermore, it is favorable that the braking member, as is actually known, is constructed as a braking arm and is hingedly secured to an axle inclined upwardly and rearwardly relative to the running surface of the ski and is inclined sloped outwardly relative to the side of the ski.

This arrangement has the advantage that the braking member can be constructed as a formed part of for example a heel jaw and causes no obstacles at all during skiing as when traversing an extreme slope or by hooking together with the adjacent binding.

A preferred exemplary embodiment is characterized by the tooth system of the braking arm being constructed in the region of the axle pivotally supporting the same and having a closing tooth and an opening tooth, wherein the closing tooth which effects during movement of the holding mechanism against a spring force the swinging of the braking arm into the retracted position has a widened front surface which corresponds approximately with the maximum length of movement of the holding mechanism.

BRIEF DESCRIPTION OF THE DRAWINGS

The invention will be described in more detail hereinbelow with reference to one exemplary embodiment and with reference to the figures in the drawings, it being understood that such illustration is not to have any limiting meaning.

FIG. 1 is a side view of an inventive ski binding in the retracted position;

FIG. 2 illustrates the ski binding with the ski boot being removed from the holding mechanism;

FIG. 3 is an enlarged illustration of the encircled part III in FIG. 2.

DETAILED DESCRIPTION

Figure 4:
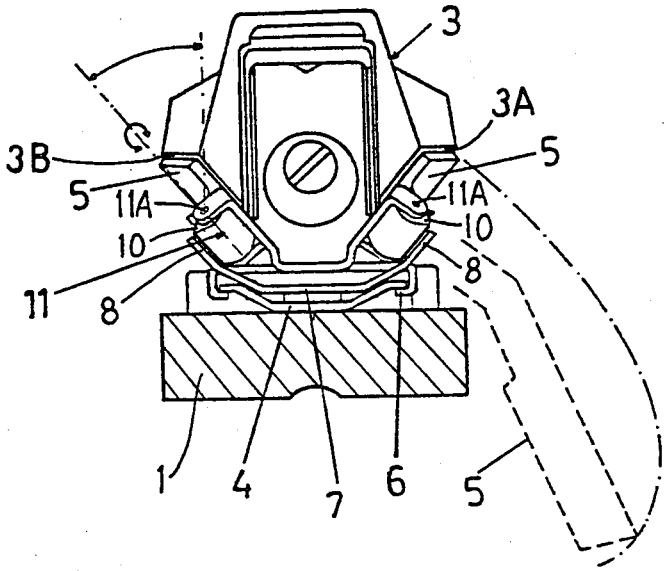
FIG. 4 is a rear view of FIG. 1 with an indicated path of swing of a braking arm.

In the illustrated exemplary embodiment, a common heel jaw 3 is movably supported in longitudinal direction of the ski on a carriage 6 which is movably supported on a base plate 4 secured to the ski. Thrust springs 12 which are not illustrated in detail are provided in the base plate or the heel jaw, which springs resiliently urge the heel jaw toward the ski boot 2. These thrust springs can be of the type shown in U.S. Pat. No. 4,022,493, assigned to the same assignee as the present invention. This resilient urging effects on the one hand a tight fit of the ski boot 2 in the ski binding and permits on the other hand a movement of the heel jaw, for example when skiing through an impression in the ground causing the ski to bend. Braking arms 5 are pivotally supported on both sides of the ski 1 and to the heel jaw 3. The axes 11 of the pivot axles 11A of the braking arms 5 are hereby, as is illustrated in FIGS. 1 and 3, inclined upwardly relative to the running surface of the ski and angled rearwardly and outwardly relative to the side of the ski. If one selects the angle of inclination of the axis 11 of an axle 11A at approximately 30° to 40° with respect to a plane perpendicular to the running surface of the ski, then the braking arms swing from their retracted position, in which they rest on the side surfaces 3A and 3B (FIG. 4) of the heel jaw 3 and do not project beyond the sides of the ski, into a braking position wherein the arms project downwardly beyond the running surface of the ski projecting at an angle from the side of the ski. The side surfaces 3A and 3B are outwardly facing and downwardly inclined as shown in FIG. 4. A tooth system, which consists of a closing tooth 9 and an opening tooth 10, is constructed in the region of the axle 11A of the braking arms 5, which tooth system is engaged by a ski-fixed operating cam 8.

The operating cam 8 is formed on an angle piece 7 secured to the ski-fixed base plate 4 through a toothed notch system (not illustrated) and can be adjusted in longitudinal direction of the ski.

If the heel jaw, as is illustrated in FIG. 2, is in its most forward position, namely if no ski boot is inserted into the ski binding, then the ski-fixed operating cam 8 cooperates with the opening tooth 10 and effects a swinging of the respective braking arm into the braking position. When the braking arm 5 is in the braking position, the cam 8 will prevent the tooth 10 from moving therepast to effect a holding of the braking arm 5 in the braking position (see FIG. 3). If now due to an insertion of the ski boot 2 into the ski binding, the heel jaw is moved rearwardly (leftwardly in FIG. 1) against the force of the thrust springs in longitudinal direction of the ski, then the fixed operating cam 8 presses against the closing tooth 9 of the tooth system on the braking arm 5 and thus effects an upward and inward swinging of the braking arm into the retracted position. The closing tooth 9 has an enlarged front surface which corresponds approximately to the maximum length of movement of the heel jaw 3, so that the braking arm is held at all times in the retracted position. During a release of the ski boot from the binding, independent from whether the heel jaw 3 or a front jaw effects the release, the heel jaw 3 moves, based on its initial tensioning of the thrust springs into the most forward position thereof, which in turn causes the braking arms to again be swung out.

It is of course possible within the scope of the invention to support the braking arms 5 on the ski-fixed base plate 4 and to mount the associated operating cam, which engages the tooth system of the braking arms, on the movable heel jaw. Also it is possible to enhance the swinging-in and swinging-out movement of the braking arms by the provision of an additional spring.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake, comprising:

an elongated guide rail adapted to be mounted on a ski;

a ski boot holding mechanism mounted on said guide rail for reciprocal movement therealong and having at least one elongated outwardly facing and downwardly inclined surface thereon;

resilient means for continually urging said holding mechanism toward one end of said guide rail, said holding mechanism moving away from said one end against the urging of said resilient means in response to an engagement of said holding mechanism with a ski boot;

elongated ski brake blade means and pivotal support means for pivotally mounting said ski brake blade means on said holding mechanism for movement between a retracted position wherein said ski brake blade means is oriented above the upper surface of said ski and in engaging relation over a major portion of the length of said blade means with said outwardly facing and downwardly inclined surface and a braking position wherein said ski brake blade means extends along a lateral edge of said ski and projects below the bottom surface of said ski, said pivotal support means including a pivot axis located below said inclined surface and which is outwardly and upwardly inclined from said guide rail, said ski brake blade means having a closing tooth means located on one side of said pivotal support means and facing in a longitudinal direction of said ski when said ski brake blade means is in said braking position; and cam means fixedly oriented relative to said guide rail means and oriented to operatively engage said closing tooth means for effecting a movement of said ski brake blade means to said retracted position in response to a movement of said holding mechanism away from said one end and said closing tooth means toward said cam means caused by an engagement of said holding mechanism with said ski boot and permitting a movement of said ski brake blade means to said braking position in response to a movement of said holding mechanism toward said one end and said closing tooth means away from said cam means under the urging of said resilient means caused by a disengagement of said holding mechanism with said ski boot.

2. The ski binding according to claim 1, wherein said pivot axis is inclined rearwardly relative to said bottom surface of said ski to cause the aforesaid movement of said blade means to a position above the upper surface of said ski and into engagement with said outwardly facing and downwardly inclined surface.

3. The ski binding according to claim 1 or claim 2, wherein the angle of inclination of said swivel axis is in the range of 30° to 40° with respect to a plane perpendicular to said bottom surface of said ski and the longitudinal axis of said ski.

* * * * *